US006635362B2

(12) United States Patent
Zheng

(10) Patent No.: US 6,635,362 B2
(45) Date of Patent: Oct. 21, 2003

(54) HIGH TEMPERATURE COATINGS FOR GAS TURBINES

(76) Inventor: Xiaoci Maggie Zheng, 11 Windsor Bldg, London Square Dr., Clifton Park, NY (US) 12065

( * ) Notice: Subject to any disclaimer, the term of this patent is extended or adjusted under 35 U.S.C. 154(b) by 0 days.

(21) Appl. No.: 09/873,964

(22) Filed: Jun. 4, 2001

(65) Prior Publication Data

US 2002/0155316 A1 Oct. 24, 2002

Related U.S. Application Data

(60) Provisional application No. 60/269,685, filed on Feb. 16, 2001.

(51) Int. Cl.[7] ..... B32B 15/04; F03B 3/12

(52) U.S. Cl. ..... 428/678; 428/403; 428/548; 428/570; 428/650; 428/323; 428/328; 428/332; 428/680; 416/241 R; 420/442; 420/445; 420/455; 420/460; 420/550

(58) Field of Search ..... 428/403, 546, 428/548, 570, 650, 651, 652, 323, 328, 332, 678, 680; 416/241 R; 420/442, 445, 455, 460, 550

(56) References Cited

U.S. PATENT DOCUMENTS

| | | | |
|---|---|---|---|
| 3,873,347 | A | 3/1975 | Walker et al. |
| 3,874,901 | A | 4/1975 | Rairden, III |
| 3,961,098 | A | 6/1976 | Bessen |
| 4,080,486 | A | 3/1978 | Walker et al. |
| 4,095,003 | A | 6/1978 | Weatherly et al. |
| 4,109,061 | A | 8/1978 | Beale et al. |
| 4,123,595 | A | 10/1978 | Chang |
| 4,152,223 | A | 5/1979 | Wallace et al. |
| 4,246,323 | A | 1/1981 | Bornstein et al. |
| 4,275,124 | A | 6/1981 | McComas et al. |
| RE30,995 | E | 7/1982 | Rairden, III |
| 4,382,976 | A | 5/1983 | Restall |
| RE31,339 | E | 8/1983 | Dardi et al. |
| RE32,121 | E | 4/1986 | Gupta et al. |
| 4,585,481 | A | 4/1986 | Gupta et al. |
| 4,687,678 | A | 8/1987 | Lindblom |
| 4,897,315 | A | 1/1990 | Gupta |
| 4,910,092 | A | 3/1990 | Olson et al. |
| 4,916,022 | A | 4/1990 | Solfest et al. |

(List continued on next page.)

FOREIGN PATENT DOCUMENTS

| | | | |
|---|---|---|---|
| WO | WO 99/23279 | 5/1999 | ..... C23C/30/00 |
| WO | 1088910 A1 | 9/2000 | ..... C23C/30/00 |

OTHER PUBLICATIONS

Chan et al., *Material at High Temperatures*, 2000; vol. 17, No. 2: pp. 173–178 No month.

*Primary Examiner*—Deborah Jones
*Assistant Examiner*—Jennifer McNeil
(74) *Attorney, Agent, or Firm*—Heslin Rothenberg Farley & Mesiti P.C.; Mary Louise Gioeni, Esq.

(57) ABSTRACT

Coating for high temperature gas turbine components that include a MCrAlX phase, and an aluminum-rich phase, significantly increase oxidation and cracking resistance of the components, thereby increasing their useful life and reducing operating costs. The aluminum-rich phase includes aluminum at a higher concentration than aluminum concentration in the MCrAlX alloy, and an aluminum diffusion-retarding composition, which may include cobalt, nickel, yttrium, zirconium, niobium, molybdenum, rhodium, cadmium, indium, cerium, iron, chromium, tantalum, silicon, boron, carbon, titanium, tungsten, rhenium, platinum, and combinations thereof, and particularly nickel and/or rhenium. The aluminum-rich phase may be derived from a particulate aluminum composite that has a core comprising aluminum and a shell comprising the aluminum diffusion-retarding composition.

34 Claims, 4 Drawing Sheets

U.S. PATENT DOCUMENTS 4,933,239 A 6/1990 Olson et al.
5,087,477 A 2/1992 Giggins, Jr. et al.
5,236,745 A 8/1993 Gupta et al.
5,277,936 A 1/1994 Olson et al.
5,395,694 A * 3/1995 Sogabe et al.
5,489,449 A * 2/1996 Umeya et al.
5,531,590 A 7/1996 Browning
5,556,713 A 9/1996 Leverant
5,582,635 A 12/1996 Czech et al.
5,652,028 A 7/1997 Taylor et al.
5,716,720 A 2/1998 Murphy
5,741,556 A 4/1998 Taylor et al.
5,817,371 A 10/1998 Gupta et al.
5,817,372 A 10/1998 Zheng
6,096,381 A 8/2000 Zheng
6,129,991 A 10/2000 Warnes et al.
6,136,453 A * 10/2000 Ritter et al.
6,143,141 A 11/2000 Leverant et al.
6,149,389 A 11/2000 Hennies et al.
6,165,628 A 12/2000 Borom et al.
6,180,259 B1 * 1/2001 Harada et al.

* cited by examiner

HIGH TEMPERATURE COATINGS FOR GAS TURBINES

CROSS-REFERENCE TO RELATED APPLICATIONS

This application claims priority from U.S. Provisional Application Serial No. 60/269,685, filed on Feb. 16, 2001.

STATEMENT AS TO RIGHTS UNDER FEDERALLY SPONSORED RESEARCH

This invention was made with support from the United States Department of Energy under Grant No. DE-PS36-00GO10518. The United States government may have rights in the invention.

FIELD OF THE INVENTION

The invention relates to composite MCrAlX-based coatings for superalloy substrates.

BACKGROUND OF THE INVENTION

Turbine manufacturers have for years used MCrAlX coatings to protect the hot-section components of turbines against corrosion and oxidation. (M is iron, cobalt, nickel, or a combination thereof; X is yttrium, hafnium, tantalum, molybdenum, tungsten, rhenium, rhodium, cadmium, indium, titanium, niobium, silicon, boron, carbon, zirconium, cerium, platinum, or a combination thereof.) As turbine efficiency increases with operating temperature, it is desirable to operate at very high firing temperatures. For applications experiencing these extremely high firing temperatures, more aluminum is added to enhance the coating's protection. However, when the aluminum concentration exceeds 10–13 weight %, the MCrAlX coating tends to become brittle, often causing delamination of the coating from the substrate. It has become common practice to apply a protective aluminide layer containing 25–35 wt. % aluminum over a MCrAlX coating containing 10 wt. % or less aluminum, in order to increase the amount of aluminum available for oxidation resistance, while prevent failure of the coating by delamination. Unfortunately, the aluminide layer itself is subject to brittleness and cracking, and cracks generated in the brittle aluminide layer can penetrate through the underlying MCrAlX layer and into the substrate, shortening the life of the component.

Accordingly, what is needed is a coating that possesses ductility to minimize crack propagation, while still preserving the necessary oxidation resistance conferred by the presence of an adequate amount of aluminum in the coating.

SUMMARY OF THE INVENTION

It has been unexpectedly discovered that use of the composite coatings of the present invention, over a superalloy substrate can significantly improve performance of parts fabricated therefrom. These composite MCrAlX coatings are designed to have a high aluminum concentration while retaining desired ductility. These coatings include a MCrAlX phase, and an aluminum-rich phase having an aluminum concentration higher than that of the MCrAlX phase, and including an aluminum diffusion-retarding composition. The aluminum rich phase supplies aluminum to the coating at about the same rate that aluminum is lost through oxidation, without significantly increasing or reducing the concentration of aluminum in the MCrAlX phase of the coating. The result is excellent oxidation resistance, without an increase in brittleness.

In addition, and in contrast to the two-step process for application of aluminized MCrAlX coatings currently applied on many gas turbine components, the one-step process for applying the coatings of the present invention results in process time and cost savings. For example, the cost of the two-step process is estimated at $2,500 per first-stage bucket, if applied on a large industrial gas turbine bucket, or $230,000.00 for one set of 92 first stage buckets. Because the coating of the present invention does not require an aluminization step, production costs are reduced by half, that is, by approximately $1,250 per bucket, or $115,000 for the set. Further savings may be realized from the doubling of the fatigue life of the first stage buckets made of expensive, nickel-based superalloy. Overall, it is estimated that these savings are equivalent to 4.25% in operating efficiencies.

Elimination of the aluminization step also provides an environmental advantage. Each run of the pack cementation aluminization or "above-the-pack" aluminization process produces hundreds of pounds of waste powder containing 1–2% hexavalent chromium, a water soluble substance regulated by the EPA. In comparison, the coating of the present invention is applied without the aluminization process, using materials that are not EPA-regulated.

Accordingly, in one aspect, the present invention relates to a high temperature coating including a MCrAlX phase and an aluminum-rich phase, wherein the amount of the MCrAlX phase ranges from 50–90 parts by weight, and the amount of the aluminum-rich phase ranges from 10–50 parts by weight; in particular, the amount of the MCrAlX phase may range from 70–90 parts by weight, and the amount of the aluminum-rich phase ranges from 10–30 parts by weight; more specifically, the amount of the MCrAlX phase may range from 85–90 parts by weight, and the amount of the aluminum-rich phase may range from 10–15 parts by weight. In the context of the present invention, numerical values recited include all values from the lower value to the upper value in increments of one unit provided that there is a separation of at least two units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1, as appropriate. These are only examples of what is specifically intended and all possible combinations of numerical values between the lowest value and the highest value enumerated are to be considered to be expressly stated in this application in a similar manner.

In another aspect, the invention relates to a particulate aluminum composite including a core comprising aluminum, and a shell comprising an aluminum diffusion-retarding composition, whereby the diffusion rate of aluminum from the core to an outer surface of the particles is reduced. The amount of the core may range from 20–95 parts by weight, and of the shell from 5–80 parts by weight.

In yet another aspect, the invention relates to a crack-resistant gas turbine component including the high temperature coating composition of the present invention, and a superalloy substrate.

DETAILED DESCRIPTION OF THE INVENTION

Figure 1:
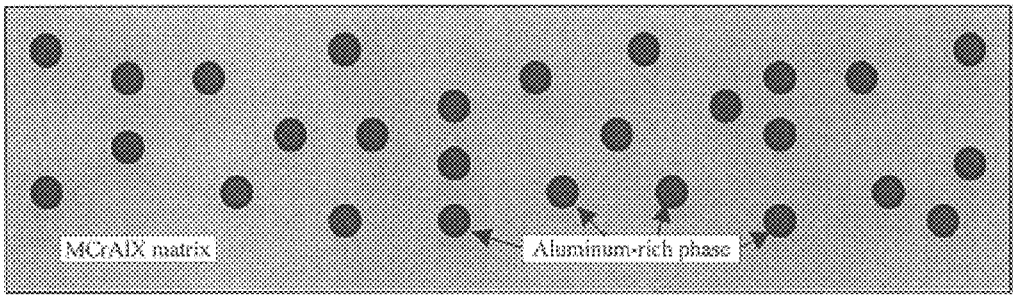
FIG. 1 is a cross-sectional schematic of an embodiment of a high temperature composite coating according the present invention, wherein an aluminum-rich phase composed of aluminum or an aluminum-rich alloy and an aluminum diffusion-retarding composition dispersed in a MCrAlX matrix.

The high temperature coating composition of the present invention includes a MCrAlX phase, and an aluminum-rich phase including an aluminum diffusion-retarding composition; M is nickel, cobalt, iron or a combination thereof, and X is yttrium, hafnium, tantalum, molybdenum, tungsten, rhenium, rhodium, cadmium, indium, titanium, niobium, silicon, boron, carbon, zirconium, cerium, platinum, or a combination thereof. This is shown schematically in FIG. 1. The concentration of aluminum in the aluminum-rich phase should be higher than that in the MCrAlX phase. The MCrAlX phase is typically the continuous phase, and the aluminum-rich phase is dispersed therein. MCrAlX alloys are known in the art. The amount of aluminum in the MCrAlX phase in the coating typically ranges from 6–14%. The amount of the MCrAlX phase in the coating ranges from 50–90 wt. %, particularly, 70–90 wt. %, and specifically 85–90 wt. %.

The coatings also include an aluminum-rich phase, in amounts of 10–50 wt. %, particularly 10–30 wt. % and specifically 10–15 wt. %. The aluminum rich phase contains aluminum at a concentration higher than the concentration in the MCrAlX phase, in order to supply aluminum to the MCrAlX phase. For example, when the MCrAlX phase contains 6–14 wt. % aluminum, the aluminum-rich phase typically contains at least 15 wt. % aluminum. The amount of aluminum may be higher than the stated minimum, up to about 80 wt. % of the aluminum-rich phase. The maximum amount of aluminum contained in the aluminum-rich phase is limited by the amount of the diffusion-retarding composition contained therein.

The aluminum-rich phase also includes a diffusion-retarding composition, and may additionally include the primary element of the MCrAlX phase, M (nickel, cobalt or iron, or combinations thereof.) The diffusion-retarding composition includes cobalt, nickel, yttrium, zirconium, niobium, molybdenum, rhodium, cadmium, indium, cerium, iron, chromium, tantalum, silicon, boron, carbon, titanium, tungsten, rhenium, platinum, and combinations thereof. In particular, the diffusion-retarding composition may include rhenium, nickel, or a combination of nickel and rhenium. It should be noted, however, that when the diffusion-retarding composition is nickel, the aluminum-rich phase may not be NiAl or CoAl or other brittle alloy phases, or mixtures thereof, because cracks are readily initiated in such a composition. In addition, the aluminum-rich phase should not include a significant amount of compositions that promote rapid diffusion of aluminum, or increase the rate thereof, such as the compositions consisting of NiAl or mixtures of NiAl and diffusion promoting compositions such as $Ni_2Al_3$. The amount of diffusion-retarding composition in the aluminum-rich phase ranges from 5–80%, and particularly from 40–60%. The amount of diffusion-retarding composition in the aluminum-rich phase is limited by the amount of aluminum contained therein, and is typically less than about 85%. If desired, the aluminum-rich phase may additionally include nickel, cobalt, iron, chromium, silicon, rhenium, platinum, palladium, zirconium, manganese, tungsten, titanium, molybdenum, rhodium, cadmium, indium, boron, carbon, niobium, hafnium, tantalum, lanthanum, cerium, praesodyium, neodymium, promethium, samarium, europium, gadolinium, terbium, dysporsium, holmium, erbium, thulium, ytterbium, and lutetium.

Figure 2:
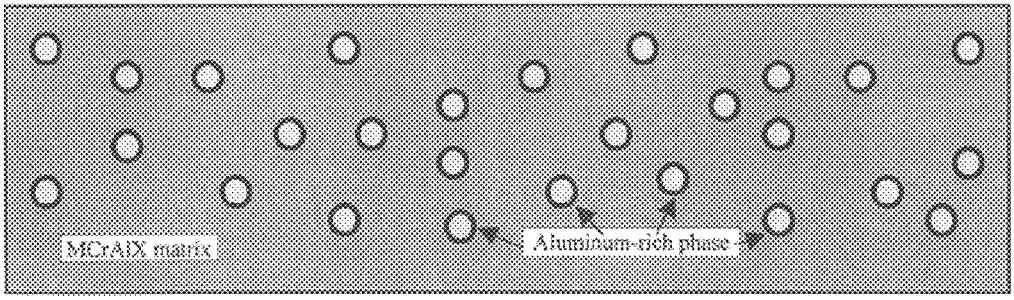
FIG. 2 is a cross-sectional schematic of a high temperature composite coating according the present invention, having an aluminum-rich phase dispersed in a MCrAlX matrix. The aluminum-rich phase is derived from a particulate aluminum composite having a core composed of aluminum or an aluminum-rich alloy, and a shell composed of a diffusion-retarding material or composition.

In one embodiment, the aluminum-rich phase is derived from a particulate aluminum composite having a core that includes aluminum, and a shell that includes an aluminum diffusion-retarding composition. A coating containing such an aluminum-rich phase is shown schematically in FIG. 2. The figure depicts the particles as spherical, but the coating composition of the present invention is not limited to any particular shape for the aluminum-rich phase. The particles contain 20–95 parts by weight of the core and 5–80 parts by weight of the shell, and particularly 40–60 parts by weight of the core and 60–40 parts by weight of the shell. The core contains aluminum at a higher level or concentration than that of the MCrAlX phase, typically at least 15%, and may be as high at 100%. If desired, the core may additionally include nickel, cobalt, iron, chromium, silicon, rhenium, platinum, palladium, zirconium, manganese, tungsten, titanium, molybdenum, rhodium, cadmium, indium, boron, carbon, niobium, hafnium, tantalum, lanthanum, cerium, praesodyium, neodymium, promethium, samarium, europium, gadolinium, terbium, dysporsium, holmium, erbium, thulium, ytterbium, and lutetium.

The shell includes an aluminum diffusion-retarding composition, which may be cobalt, nickel, yttrium, zirconium, niobium, molybdenum, rhodium, cadmium, indium, cerium, iron, chromium, tantalum, silicon, boron, carbon, titanium, tungsten, rhenium, platinum, and combinations thereof. In particular, the shell may include nickel or rhenium, or a combination thereof. If desired, the shell may additionally contain palladium, manganese, hafnium, lanthanum, praesodyium, neodymium, promethium, samarium, europium, gadolinium, terbium, dysporsium, holmium, erbium, thulium, ytterbium, and lutetium.

The shell may be composed of two or more layers, each composed of a different diffusion-retarding composition, or of a diffusion-retarding composition and another composition. In particular, the shell may be composed of a diffusion-retarding inner layer, and an outer layer composed of the primary element(s) of the MCrAlX phase, in order to promote compatibility between the particle and the matrix. For example, for a particle in a MCrAlX matrix having nickel as the primary element M the shell may have a first or inner layer of rhenium, and a second or outer layer of nickel. The proportion of nickel to rhenium in the particle ranges from a ration of 9:1 by weight to 1:9. The composite aluminum particles of the present invention may be prepared by fabricating a shell over an aluminum-containing particle. The aluminum-containing particle may be spherical, may be in the form of flakes or fibers, may contain segments of other shapes, or may be a mixture of one or more of these. Final particle size typically ranges from 1 micron to 50 microns.

The materials of the high temperature coating composition of the present invention may be prepared by simple mixing of powders of the MCrAlX phase and the aluminum-rich phase. The coating may be applied using the same equipment and procedures as for MCrAlX coatings of the prior art, for example, thermal spray methods, such as vacuum plasma spray (VPS) or high velocity oxygen or air fuel spray (HVOF or HVAF). As for prior art MCrAlX coatings, formation of excess oxides and porosity in coating should be avoided. No high temperature heat treatment is required after the composite coating is applied, although a heat treatment may be applied, if desired.

EXAMPLES

Example 1 (Comparative): Bare Superalloy

Samples of single crystal, directionally solidified superalloy substrates were fabricated by a casting process. The composition of the superalloy was Ni60.5/Co9.5/Cr14/Al3/X13, where X is Ta, W, Mo, Ti, Zr, C, and/or B.

Example 2 (Comparative): Aluminized MCrAlX-Coated Superalloy

Specimens having dimensions suitable for the cyclic oxidation test and low cycle fatigue test, both described below, were machined from the superalloy specimens of Example 1. A MCrAlX coating having a composition of Co35.7/Ni32/Cr22/Al10/Y0.3 was applied thereto using an HVOF spray process. An aluminized coating was applied over the MCrAlX coating by a pack cementation process. Compositional and process data are summarized in Table 1.

TABLE 1

| | Comparative Examples | |
|---|---|---|
| | Example 1 Bare Substrate | Example 2 Aluminized MCrAlX |
| Coating Powder Chemistry | N/A | Co35.7/Ni32/Cr22/Al10/Y0.3 |
| Coating Powder Fabrication Method | N/A | Gas atomization in vacuum |
| Coating Powder Morphology | N/A | Spherical |
| Coating Powder Size | N/A | <0.044 mm |

TABLE 1-continued

| | Comparative Examples | |
|---|---|---|
| | Example 1 Bare Substrate | Example 2 Aluminized MCrAlX |
| Coating Process Method | N/A | High velocity oxygen fuel spray |
| Coating Thickness | N/A | 0.25–0.30 mm |
| Coating Surface Polish | N/A | <100 Ra |
| Top Aluminide Coating | N/A | Pack cementation |
| Aluminide Coating Thickness | N/A | 0.06–0.08 mm |
| Al wt. % in Aluminide Coating | N/A | 25–35 wt. % |
| Substrate Chemistry (X-Ta, W, Mo, Ti, Zr, C, B) | Ni60.5/Co9.5/Cr14/Al3/X13 | Ni60.5/Co9.5/Cr14/Al3/X13 |
| Substrate Microstructure | Directionally solidified | Directionally solidified |
| Substrate Fabrication Method | Casting | Casting |

Examples 3–5: Composite Coatings

Example 3: Ni—Re Shell

A composite coating powder containing a particulate aluminum composite having the composition Ni-33.79, Al-58.11, Re-25.32 weight percent was applied to specimens machined from the superalloy specimens of Example 1, using an HVOF process. The particulate aluminum composite was prepared by applying a shell to a spherical aluminum core particle by a plating process. The composite coating was prepared by mechanically mixing a MCrAlX matrix powder, of composition Co38.5/Ni32/Cr21/Al8/Y0.5, with the particulate aluminum composite.

Example 4: Ni Shell

A composite coating powder containing a particulate aluminum composite having the composition Ni-48.24, Al-45.46 weight percent was applied to specimens machined from the superalloy specimens of Example 1, using an HVOF process. The particulate aluminum composite was prepared by applying a shell to a spherical aluminum core particle by a plating process. The composite coating was prepared by mechanically mixing a MCrAlX matrix powder, of composition Co38.5/Ni32/Cr21/Al8/Y0.5, with the particulate aluminum composite.

Example 5: Ni Shell

A composite coating powder containing a particulate aluminum composite having the composition Ni-48.24, Al-45.46 weight percent was applied to specimens machined from the superalloy specimens of Example 1, using an HVAF process. The particulate aluminum composite was prepared by applying a shell to a spherical aluminum core particle by a plating process. The composite coating was prepared by mechanically mixing a MCrAlX matrix powder, of composition Co38.5/Ni32/Cr21/Al8/Y0.5, with the particulate aluminum composite.

TABLE 2

| | Experimental Coatings | | |
|---|---|---|---|
| | Example 3 | Example 4 | Example 5 |
| Matrix Powder Chemistry | Co38.5/Ni32/ Cr21/Al8/Y0.5 | Co38.5/Ni32/ Cr21/Al8/Y0.5 | Co38.5/Ni32/ Cr21/Al8/Y0.5 |
| Matrix Powder Fabrication Method | Gas atomization in vacuum | Gas atomization in vacuum | Gas atomization in vacuum |
| Matrix Powder Morphology | Spherical | Spherical | Spherical |
| Matrix Powder Size | <0.044 mm | <0.044 mm | <0.044 mm |
| Secondary Powder Chemistry | Ni-33.79, Al-58.11, Re-25.32 weight percent | Ni-48.24, Al-45.46 weight percent | Ni-48.24, Al-45.46 weight percent |
| Secondary Powder Fabrication Method | Core-gas atomization, Shell-plating | Core-gas atomization, Shell-plating | Core-gas atomization, Shell-plating |
| Secondary Powder Morphology | Spherical Al-core, Ni-1st shell, Re-2nd shell | Spherical Al-core, Ni-shell | Spherical Al-core, Ni-shell |
| Secondary Powder Size | <0.044 mm | <0.044 mm | <0.044 mm |
| Matrix/Secondary Powder Mix Weight Ratio | 87 parts/13 parts in weight percent | 88 parts/12 parts in weight percent | 88 parts/12 parts in weight percent |
| Coating Process Method | High velocity oxygen fuel spray | High velocity oxygen fuel spray | High velocity air fuel spray |
| Coating Thickness | 0.25–0.30 mm | 0.25–0.30 mm | 0.25–0.30 mm |
| Coating Surface Polish | <100 Ra | <100 Ra | <100 Ra |
| Substrate Chemistry (X-Ta, W, Mo, Ti, Zr, C, B) | Ni60.5/Co9.5/ Cr14/Al3/X13 | Ni60.5/Co9.5/ Cr14/Al3/X13 | Ni60.5/Co9.5/ Cr14/Al3/X13 |
| Substrate Microstructure | Directionally solidified | Directionally solidified | Directionally solidified |
| Substrate Fabrication Method | Casting | Casting | Casting |

Example 6: Cyclic Oxidation Test

Figure 3:
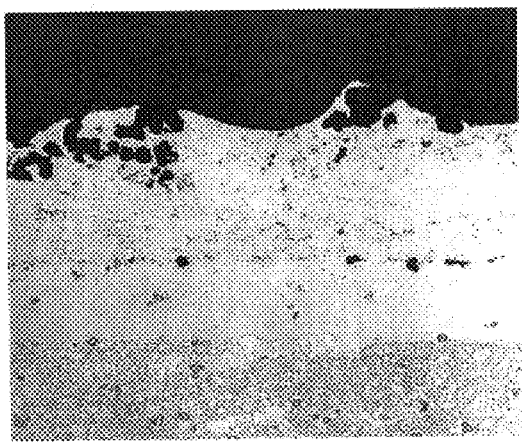
FIG. 3 is a micrograph showing the surface of a cyclic oxidation specimen having an aluminide-MCrAlX coating, after 1660 hours testing at 2000° F., showing depletion of aluminum and decay of the coating.
Figure 4:
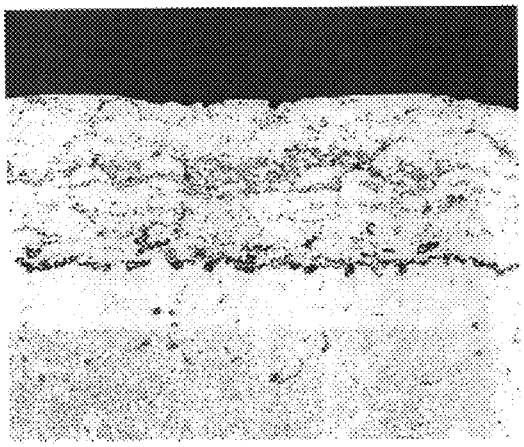
FIG. 4 is a micrograph showing the surface of a cyclic oxidation specimen having a composite coating according to the present invention, after 1660 hours testing at 2000° F., showing residual aluminum and an integral upper surface. The aluminum content in the coatings shown in FIG. 3 and FIG. 4 were the same before the oxidation test.

Superalloy specimen buttons 1.0 inch (25 mm) in diameter and 0.125 inches (3 mm) thick were coated according to the procedure of Examples 2 (aluminized MCrAlX) and 3 ((Ni—Re shell composite and MCrAlX matrix), and were held in a testing furnace for 1660 hours. The coatings had equivalent total aluminum content before testing. The temperature of the furnace was raised from ambient temperature to 2000° F. (1093° C.), held at 2000° F. for 20 hours, and returned to ambient temperature. The samples were inspected for coating decay and delamination every five cycles. The heating/cooling cycles were repeated for a total test time of 1660 hours. Micrographs of the specimens show that after 1660 hours, aluminum was depleted from the coating of Example 2 due to oxidation (FIG. 3), while residual aluminum remained in the composite coating of Example 3 (FIG. 4). FIG. 3 shows that the aluminum-rich$Ni_3$ Al phase was completely depleted and that coating had a disintegrated surface morphology, indicating severe oxidation. FIG. 4 shows that a residual $\gamma$-$Ni_3Al$ phase remained in the middle of the coating and coating retained its integrity, indicating resistance to oxidation.

Example 7: Low Cycle Fatigue Test

Superalloy specimen bars suitable for the low cycle fatigue (LCF) test were coated according to the procedure of Examples 2–5, and were evaluated for resistance to fatigue cracking after exposure to thermal and mechanical stress cycles. For the test, the two threaded ends of LCF bar were gripped by the test machine, and heated to 1600° F. A tensile stress and a compressive stress was alternately applied along the axis of the bar held for two minutes at the end of each cycle to simulate stresses experienced by the parts under operating conditions. The test was performed at strain levels of 0.8% and 1.0%. The number of cycles when cracks were first detected (crack initiation) and when cracks penetrated through the entire bar (failure) were recorded. Results are shown in Table 3, and in FIGS. 5–8.

TABLE 3

| | Low Cycle Fatigue Testing Results | | | |
|---|---|---|---|---|
| | 0.8% Strain | | 1% Strain | |
| Example No./ Composition | Cycles to Crack Initiation | Cycles to Failure | Cycles to Crack Initiation | Cycles to Failure |
| 1 (Comparative) | 656 | 757 | 446 | 457 |
| 3 (Comparative) | 684 | 1082 | 389 | 453 |
| 4 (Ni-Re Shell) | 1488 | 1530 | 772 | 862 |
| 5 (Ni Shell) | 1207 | 1641 | 688 | 894 |
| 6 (Ni Shell) | 1083 | 1221 | 480 | 813 |

It can be seen from Table 3 that all specimens fabricated using the composite coatings of the present invention were significantly more durable under the test conditions than the uncoated specimen or the specimen with the aluminized MCrAlX coating. In most cases, the number of cycles to crack initiation or to failure for the experimental samples were about twice that for the comparative examples.

Figure 5:
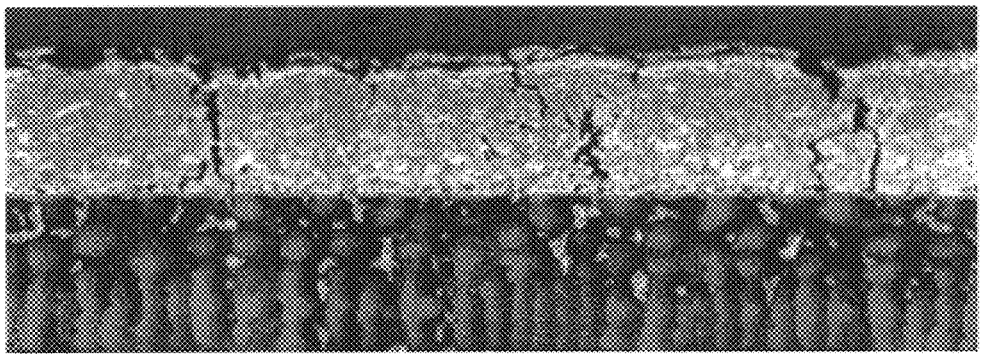
FIG. 5 is a micrograph of the surface region of a low cycle fatigue specimen having an aluminide+MCrAlX coating tested at 1600° F. and 0.8% strain with two minutes hold time, showing multiple large crack initiation and penetration through the coating and reach into the substrate when the specimen was fractured after 684 cycles.
Figure 6:
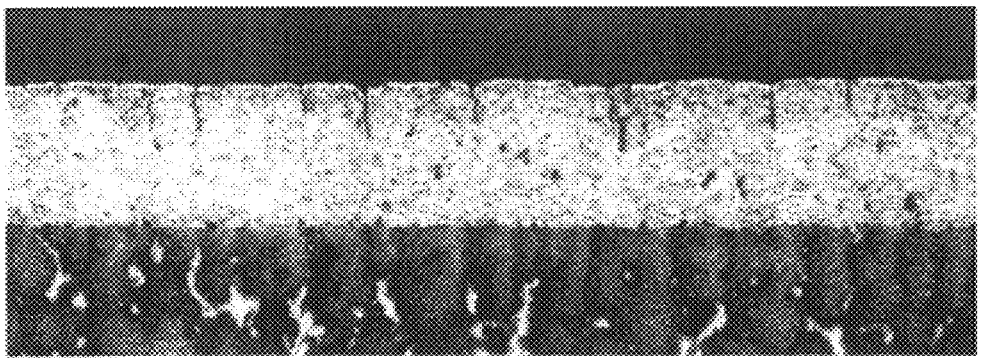
FIG. 6 is a micrograph of the surface region of a low cycle fatigue specimen having a composite coating according to the present invention tested at 1600° F. and 0.8% strain with two minutes hold time, showing multiple small crack initiation but no penetration through the coating when the specimen was fractured after 1488 cycles with a single crack penetration.
Figure 7:
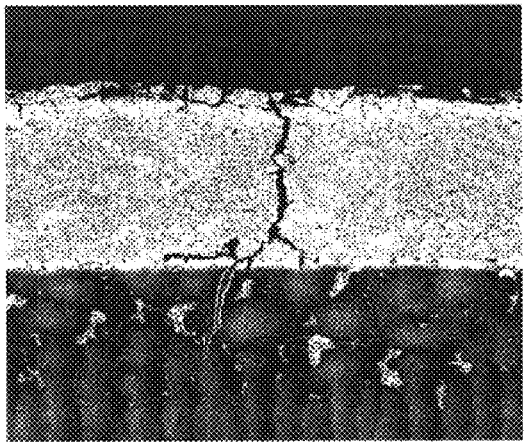
FIG. 7 is a micrograph of the surface of a low cycle fatigue specimen having an aluminide+MCrAlX coating, showing a discrete crack propagated from the coating into the substrate.
Figure 8:
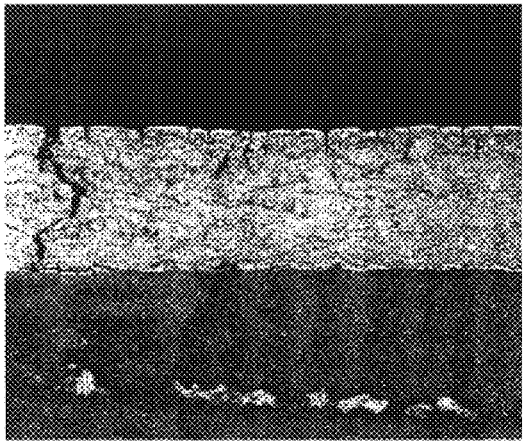
FIG. 8 a micrograph of the surface of a low cycle fatigue specimen having a composite coating according to the present invention, showing a discrete crack propagated along the interface between the coating and substrate.

FIG. 5 shows a specimen having the aluminide-MCrAlX coating of Example 2, after failure at 684 cycles. Multiple large cracks are visible in the coating with a large distance between them. In comparison, FIG. 6 shows a specimen having the composite coating of Example 3, after 1488 cycles. Multiple small cracks are visible at the surface of the coating with a smaller distance between them. Comparison of crack propagation patterns between FIG. 7 and FIG. 8 shows that the specimen having the coating of Example 2, had large cracks propagated from the coating into the substrate, while the specimen having the experimental coating of Example 3 had small cracks near the surface, and cracks were propagated along the interface between the coating and the substrate.

What is claimed is:

1. A high temperature coating composition comprising:

a MCrAlX phase;

an aluminum-rich phase comprising aluminum at a higher concentration than aluminum concentration in the MCrAlX alloy; and an aluminum phase diffusion-retarding phase; wherein M is nickel, cobalt, iron, or a combination thereof; and X is yttrium, hafnium, tantalum, molybdenum, tungsten, rhenium, rhodium, cadmium, indium, titanium, niobium, silicon, boron, carbon, zirconium, cerium, platinum, or a combination thereof.

2. A high temperature coating composition according to claim 1, wherein the aluminum-rich phase additionally comprises M.

3. A high temperature coating composition according to claim 1, wherein said aluminum diffusion-retarding phase comprises at least one metal selected from the group consisting of cobalt, nickel, yttrium, zirconium, niobium, molybdenum, rhodium, cadmium, indium, cerium, iron, chromium, tantalum, silicon, boron, carbon, titanium, tungsten, rhenium, platinum, hafnium, lanthanum, osmium, iridium, ruthenium, palladium, scandium, and combinations thereof.

4. A high temperature coating composition according to claim 1, wherein said aluminum diffusion-retarding phase comprises rhenium.

5. A high temperature coating composition according to claim 1, wherein said aluminum diffusion-retarding phase comprises nickel.

6. A high temperature coating composition according to claim 1, wherein said aluminum diffusion-retarding phase comprises a combination of nickel and rhenium.

7. A high temperature coating according to claim 1, wherein said at least one aluminum diffusion-retarding phase comprises 10–90 wt. % nickel and 90–10 wt. % rhenium.

8. A high temperature coating according to claim 1, wherein said at least one aluminum diffusion-retarding phase comprises 40–60 wt. % nickel and 60–40 wt. % rhenium.

9. A high temperature coating according to claim 1, wherein the amount of the MCrAlX phase ranges from 50–95 parts by weight, and the amount of the aluminum-rich phase ranges from 5–50 parts by weight.

10. A high temperature coating according to claim 1, wherein the amount of the MCrAlX phase ranges from 70–90 parts by weight, and the amount of the aluminum-rich phase ranges from 10–30 parts by weight.

11. A high temperature coating according to claim 1, wherein the amount of the MCrAlX phase ranges from 85–90 parts by weight, and the amount of the aluminum-rich phase ranges from 10–15 parts by weight.

12. A high temperature coating according to claim 1, wherein the MCrAlX phase comprises no more than 10 wt. % aluminum, and the aluminum-rich phase comprises at least 15 wt. % aluminum.

13. A high temperature coating according to claim 1, wherein the aluminum-rich phase comprises at least 40 wt. % aluminum.

14. A high temperature coating according to claim 1, wherein said aluminum-rich phase comprises 30 wt. % nickel, 20 wt. % rhenium and 50 wt. % aluminum.

15. A high temperature coating composition according to claim 1, wherein said aluminum-rich phase is derived from a particulate aluminum composite comprising:

a core comprising aluminum metal; and a shell comprising at least one aluminum diffusion-retarding metal.

16. A high temperature coating composition according to claim 15, wherein the core comprises at least 15 wt. % aluminum.

17. A high temperature coating according to claim 15, wherein the core comprises at least 40 wt. % aluminum.

18. A high temperature coating composition according to claim 15, wherein the shell comprises at least one metal selected from the group consisting of rhenium, nickel, lanthanum, hafnium, tantalum, cobalt, chromium, iron, niobium, titanium molybdenum, rhodium, cadmium, indium, silicon, boron, carbon, platinum, osmium, cerium, and combinations thereof.

19. A high temperature coating composition according to claim 15, wherein the shell comprises nickel, rhenium, or a combination thereof.

20. A high temperature coating composition according to claim 15, wherein the shell comprises nickel.

21. A high temperature coating composition according to claim 15, wherein the shell comprises rhenium.

22. A high temperature coating composition according to claim 15, wherein the shell comprises a combination or nickel and rhenium.

23. A high temperature coating composition according to claim 15, wherein the shell comprises a first inner layer and a second outer layer.

24. A high temperature coating composition according to claim 23, wherein the first inner layer comprises rhenium and the second outer layer comprises nickel.

25. A high temperature coating composition according to claim 15, wherein said shell comprises:

10–90 parts by weight nickel; and

90–10 parts by weight rhenium.

26. A high temperature coating composition according to claim 15, wherein said shell comprises:

40–60 parts by weight nickel; and

60–40 parts by weight rhenium.

27. A particulate aluminum composite comprising a core comprising aluminum metal; and a shell comprising rhenium.

28. A particulate aluminum composite according to claim 27, wherein the shell comprises a combination of nickel and rhenium.

29. A particulate aluminum composite according to claim 27, wherein the shell comprises a first inner layer comprising rhenium and a second layer outer comprising nickel.

30. A particulate aluminum composite according to claim 27, wherein said shell comprises:

10–90 parts by weight nickel; and

90–10 parts by weight rhenium.

31. A particulate aluminum composite according to claim 27, wherein said shell comprises:

40–60 parts by weight nickel; and

60–40 parts by weight rhenium.

32. A particulate aluminum composite according to claim 27 comprising overall 30 wt. % nickel, 20 wt. % rhenium and 50 wt. % aluminum.

33. A crack-resistant gas turbine component comprising:

a high temperature coating composition; and a superalloy substrate, wherein said high temperature coating composition comprises:

a MCrAlX phase;

an aluminum-rich phase comprising aluminum at a higher concentration than aluminum concentration in the MCrAlX alloy; and an aluminum diffusion-retarding phase;

M is iron, cobalt nickel, or a combination thereof; and

X is yttrium, hafnium, tantalum, molybdenum, tungsten, rhenium, rhodium, cadmium, indium, titanium, niobium, silicon, boron, carbon, zirconium, cerium, platinum, or a combination thereof.

34. A high temperature coating composition according to claim 1, comprising overall 25–100 wt % M, 5–55 wt % aluminum, and 0.025–36 wt % rhenium.

* * * * *